US007367824B1

(12) United States Patent
Yen et al.

(10) Patent No.: US 7,367,824 B1
(45) Date of Patent: May 6, 2008

(54) CARD EJECTION MECHANISM FOR MEMORY CARD CONNECTOR THAT PREVENTS EJECTED CARD FROM JUMPING AWAY

(75) Inventors: Ming Hui Yen, Taipei Hsien (TW); Chin Chih Li, Taipei Hsien (TW); Chun Ming Lai, Taipei Hsien (TW)

(73) Assignee: Chant Sincere Co., Ltd., Taipei Hsien (TW)

( * ) Notice: Subject to any disclaimer, the term of this patent is extended or adjusted under 35 U.S.C. 154(b) by 0 days.

(21) Appl. No.: 11/826,749

(22) Filed: Jul. 18, 2007

(51) Int. Cl.
*H01R 13/62* (2006.01)

(52) U.S. Cl. ..... 439/152; 439/630

(58) Field of Classification Search ..... 439/152, 439/159, 630, 155, 157, 160, 629, 310, 333, 439/607, 328, 631–632
See application file for complete search history.

(56) References Cited

U.S. PATENT DOCUMENTS 6,655,973 B2 * 12/2003 Ji et al. ..... 439/159
6,976,860 B1 * 12/2005 Su ..... 439/159
2004/0056095 A1 * 3/2004 Yiu ..... 235/441

* cited by examiner

*Primary Examiner*—Edwin A. León
(74) *Attorney, Agent, or Firm*—Bacon & Thomas, PLLC

(57) ABSTRACT

A memory card ejection mechanism for use in a memory card connector and controllable to eject the inserted memory card is disclosed, in which the hook of the memory card ejection mechanism has a curved spring arm for engaging a retaining notch of the inserted memory card to hold the inserted memory card in place, and a positioning tip pressed against a wall inside a mounting groove of the slide of the memory card ejection mechanism for producing a reaction force against impact of the memory card to prohibit the memory card from jumping away as it is ejected out of the memory card connector.

4 Claims, 6 Drawing Sheets

CARD EJECTION MECHANISM FOR MEMORY CARD CONNECTOR THAT PREVENTS EJECTED CARD FROM JUMPING AWAY

BACKGROUND OF THE INVENTION (a) Field of the Invention

The present invention relates to the design of card ejection mechanism for memory card connector and more particularly, to a card ejection mechanism with improved hook structure that prevents the ejected memory card from jumping away.

(b) Description of the Prior Art

A memory card connector is known comprising an electrically insulative housing with terminal grooves, a metal cover covering the housing, a plurality of metal conducting terminals mounted in the terminal grooves of the electrically insulative housing, probe means mounted in the electrically insulative housing, and a card ejection mechanism mounted in one side inside the electrically insulative housing and adapted to eject the inserted memory card out of the electrically insulative housing. The card ejection mechanism is comprised of a slide, a spring member, a brake rod, and a hook. When one memory card is inserted into the memory card connector, the slide is forced to compress the spring member (there is another design in which the slide is forced to stretch the spring member), and the brake rod is moved along a sliding rail of the slide and positioned in one end of the sliding rail to force the hook into engagement with a retaining notch at one side of the inserted memory card. Therefore, the inserted memory card is secured in place. According to this design, the hook has a curved short spring arm having a free rear end. When a memory card is inserted into the memory card connector, the hook is compressed and forced into engagement with the retaining notch of the inserted memory card, however the free end of the hook is still kept in a suspending status. When the inserted memory card is ejected out of the memory card connector by the spring power of the spring member through the slide, the spring arm of the hook may be forced away from the retaining notch of the memory card by the impact of the spring member, causing the ejected memory card to jump away from the card ejection mechanism. In this case, the ejected memory card may be damaged or the user may need to spend much time in finding the ejected memory card. This problem is more serious in memory cards having light, thin, short and small characteristics.

SUMMARY OF THE INVENTION

The present invention has been accomplished under the circumstances in view. It is one object of the present invention to provide a card ejection mechanism for memory card connector that prevents the ejected memory card from jumping away. To achieve this and other objects of the present invention, the card ejection mechanism is comprised of a slide, which has a sliding rail and a mounting groove, a spring member connected between the slide and a part inside the memory card connector and adapted to eject the inserted memory card out of the memory card connector, a brake rod hooked between a hook hole in the memory card connector and one end of the sliding rail, and a hook mounted in the mounting groove of the slide for securing the inserted memory card in the memory card connector. The hook has a curved spring arm extending out of the mounting groove of the slide for engaging the inserted memory card to the memory card connector in place, and a positioning tip extending from one end of the spring arm and stopped against a wall inside the mounting groove of the slide and adapted to impart a reaction force against impact of the inserted memory card when the inserted memory card is ejected out of the memory card connector by the spring member so as to prohibit the ejected memory card from jumping away.

DETAILED DESCRIPTION OF THE PREFERRED EMBODIMENTS

Figure 1:
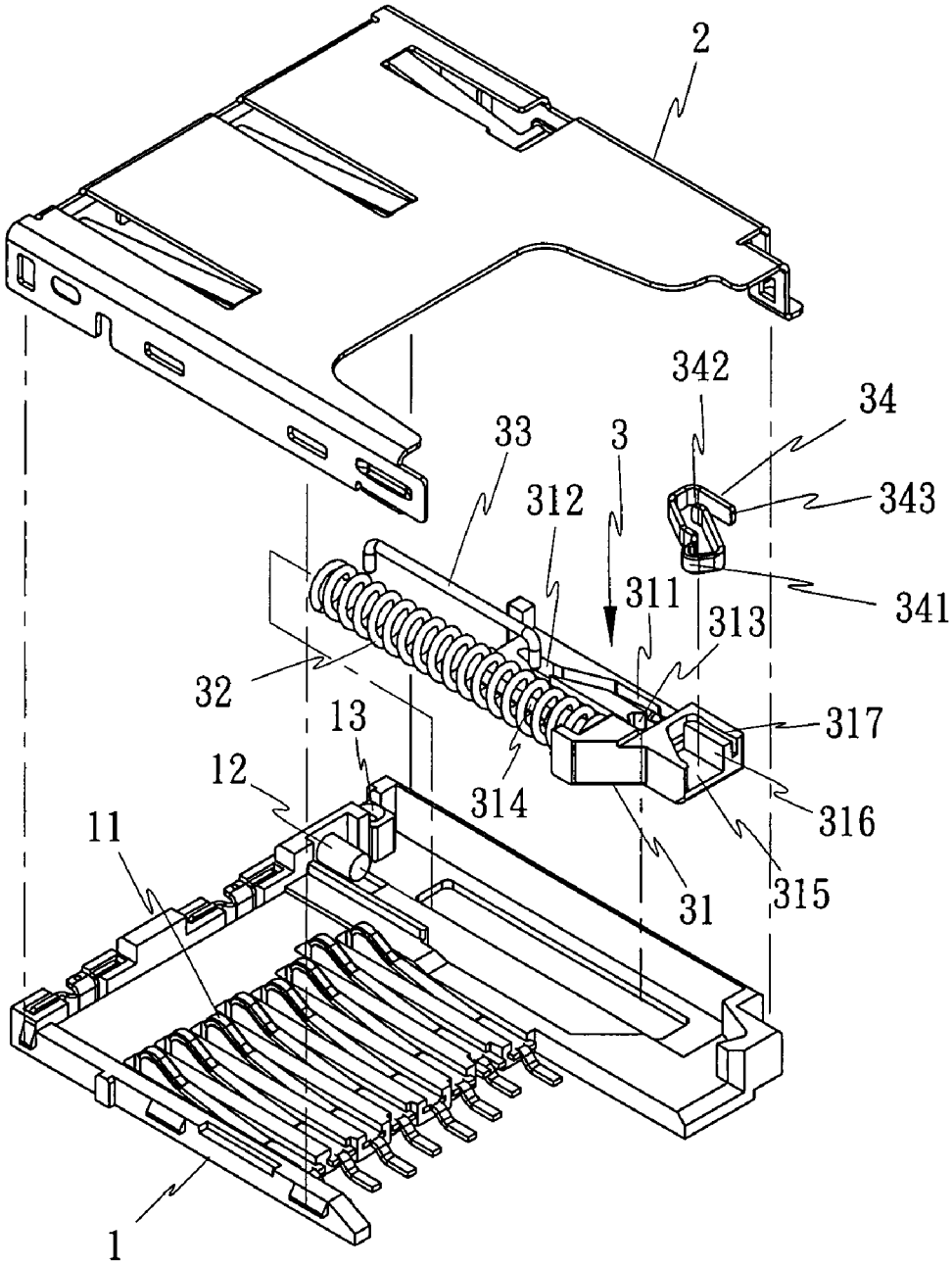
FIG. 1 is an exploded view of a memory card connector constructed according to the present invention.

Referring to FIG. 1, a memory card connector is shown comprising an electrically insulative housing 1, a metal cover 2, and a card ejection mechanism 3.

Figure 2:
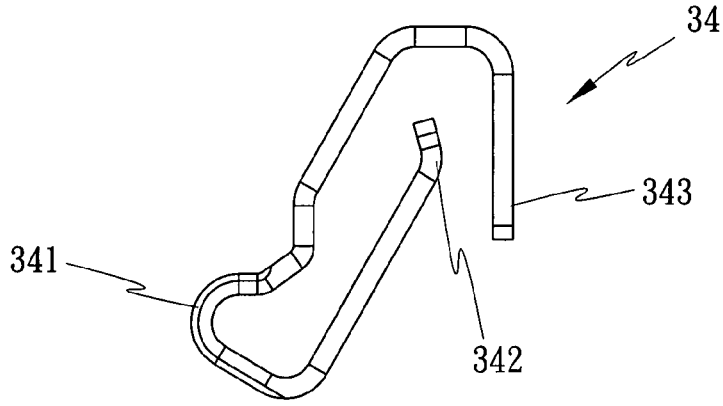
FIG. 2 is a top view of the hook of the card ejection mechanism of the memory card connector shown in FIG. 1.
Figure 3:
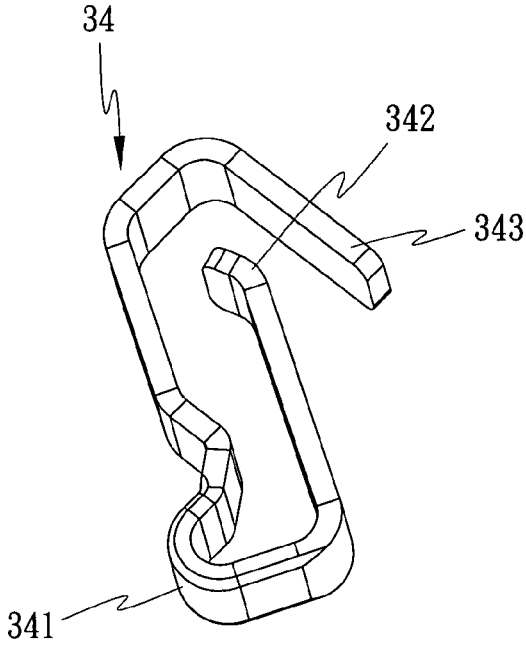
FIG. 3 is an oblique elevation of the hook shown in FIG. 2.

The electrically insulative housing 1 has mounted therein a plurality of metal conducting terminals 11. The metal cover 2 covers the electrically insulative housing 1. The card ejection mechanism 3 is mounted in one side of the electrically insulative housing 1. Further, the card ejection mechanism 3 is comprised of a slide 31, a spring member 32, a brake rod 33, and a hook 34. The spring member 32 supports the slide 31. The slide 31 has a substantially Y-shaped guide rail 311 and two locating notches, namely, the rear locating notch 312 and the front locating notch 313 at the two opposite ends of the Y-shaped guide rail 311. The spring member 32 is connected between a pin 12 at the electrically insulative housing 1 and a pin 314 at the slide 31. The brake rod 33 has its two opposite ends respectively hooked on a hook hole 13 inside the electrically insulative housing 1 and one locating notch 312 of the slide 31. The slide 31 further has a main mounting groove 315 in its front end for the mounting of the hook 34, an supplementary mounting groove 317 at one side of the main mounting groove 315, and a partition block 316 set in between the main mounting groove 315 and the supplementary mounting groove 317. The hook 34, as shown in FIGS. 2 and 3, is formed of a curved spring strip, having a spring arm 341 curved inwards and shaped like a U-turn, a front positioning tip 342 extending from one end of the spring arm 341, and a curved tailpiece 343 extending from the other end of the spring arm 341. The front positioning tip 342 is stopped against the partition block 316 of the slide 3 to give a reaction force.

During installation of the memory card connector, the hook 34 of the card ejection mechanism 3 is inserted into the main mounting groove 315 of the slide 31 with the spring arm 341 exposed to the outside of the main mounting groove 315 for the engagement of the retaining notch 41 of the inserted memory card 4 (see FIGS. 8 and 9) and the front positioning tip 342 stopped against the partition block 316 of the slide 3 to hold the hook 34 in place. When the user ejects the inserted memory card, the front positioning tip 342 is forced against the partition block 316 to impart a reaction force to the spring arm 341 to set off the impact, keeping the ejected memory card 4 is engagement with the hook 34, and therefore the ejected memory card is prohibited from jumping away.

Figure 7:
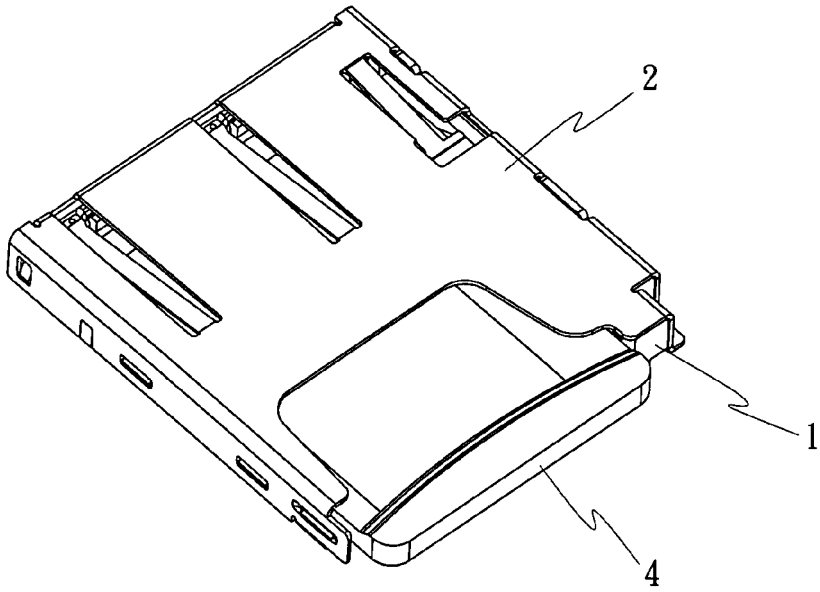
FIG. 7 is an oblique elevation of the present invention, showing a memory card inserted into the memory card connector.
Figure 8:
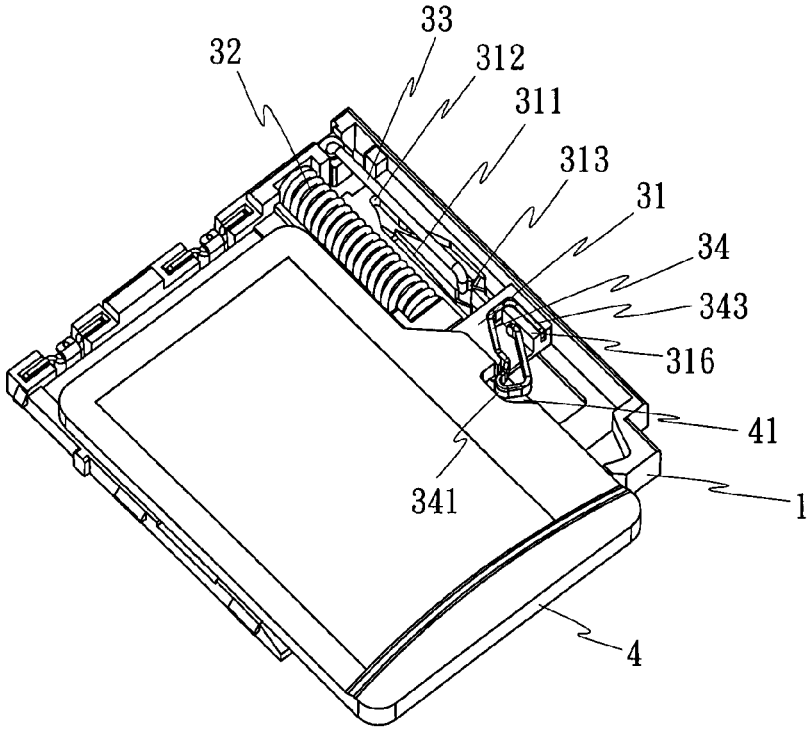
FIG. 8 corresponds to FIG. 7, showing the status of the card ejection mechanism after removal of the metal cover.
Figure 9:
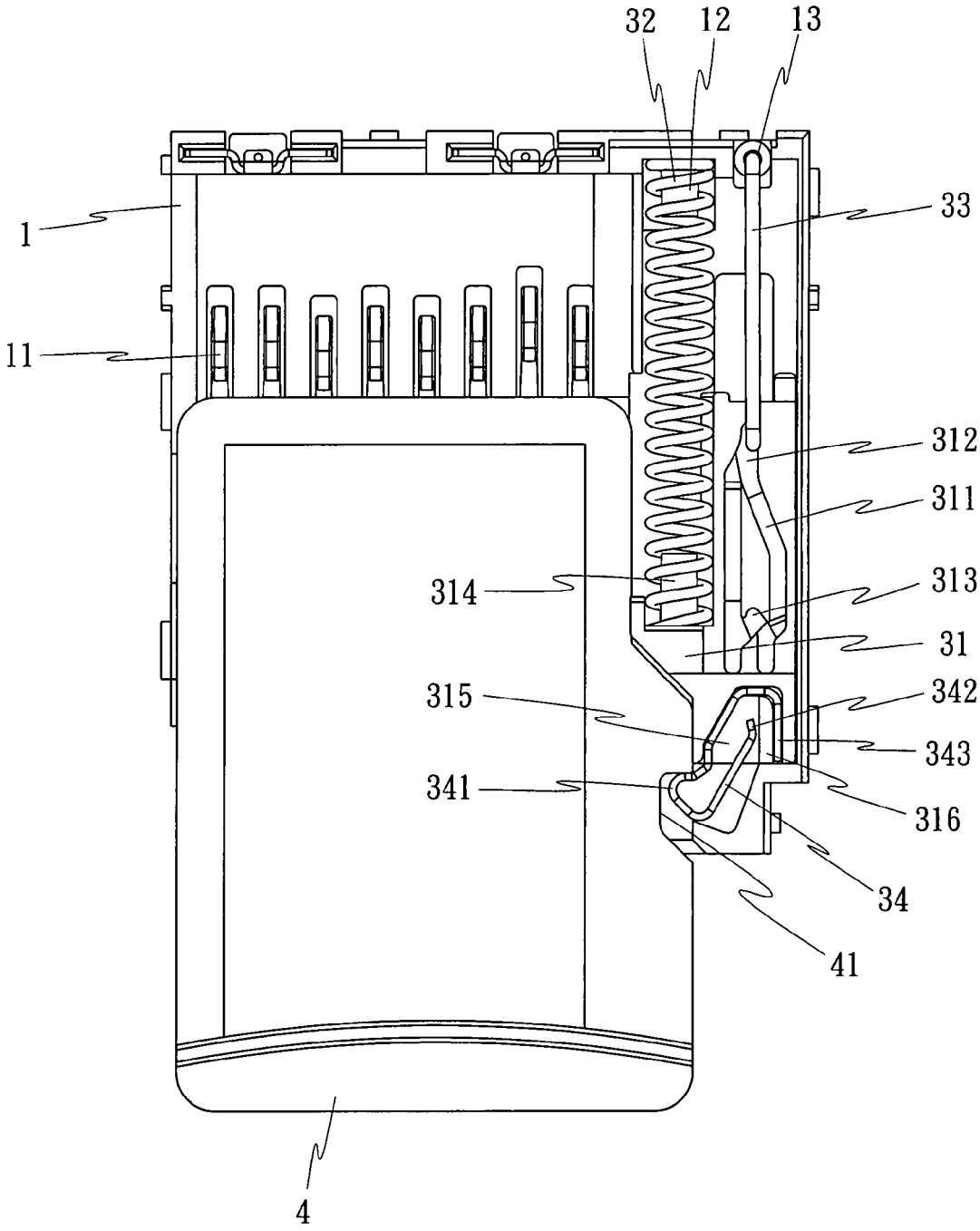
FIG. 9 is a schematic top view of the present invention, showing the hook hooked with the ejected memory card.
Figure 10:
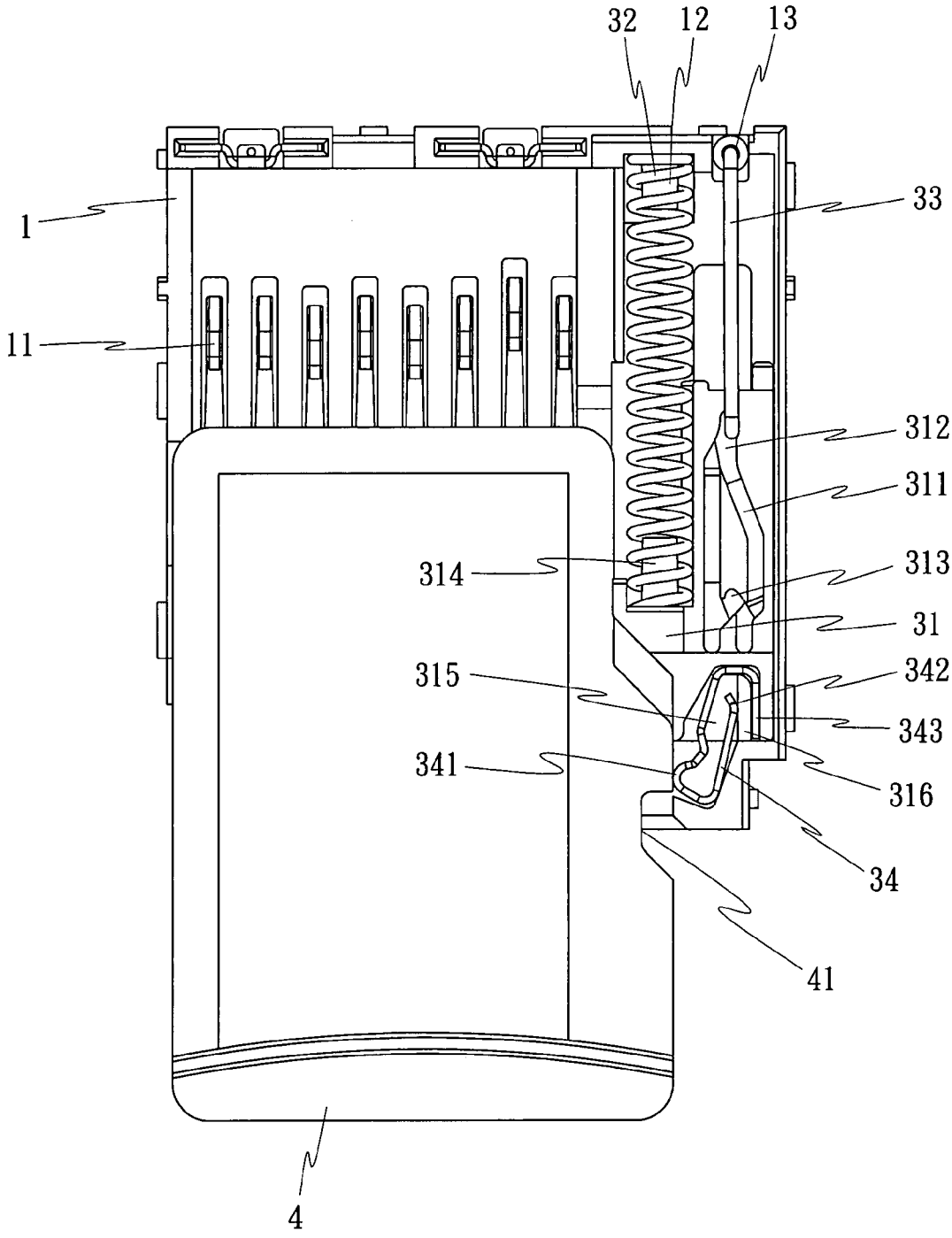
FIG. 10 corresponds to FIG. 9, showing the ejected memory card disengaged from the hook.

Referring to FIGS. 7 and 8, when the memory card 4 is inserted into the memory card connector, it moves the slide 31 to push the spring member 32, forcing the brake rod 33 to move along the Y-shaped guide rail 311 into engagement with the rear locating notch 312. At this time, the spring arm 341 of the hook 34 is forced into engagement with the retaining notch 41 at one lateral side of the inserted memory card 4, holding the inserted memory card 4 in position. When ejecting the memory card 4, push the memory card 4 inwards to disengage the brake rod 33 from the front locating notch 313 and to further release the spring member 32, and therefore the spring force of the spring member 32 pushes the slide 31 outwards to eject the memory card 4 as shown in FIG. 9. At this time, the spring arm 341 of the hook 34 is still maintained in engagement with the retaining notch 41 of the memory card 4 to prevent the memory card 4 from jumping away. The user can thus, as shown in FIG. 10, take the memory card 4 away from the memory card connector with the fingers. Therefore, the operation of the present invention is simple and convenient, preventing the ejected memory card from jumping away. Therefore, the invention prevents damage to the ejected memory card 4.

Figure 5:
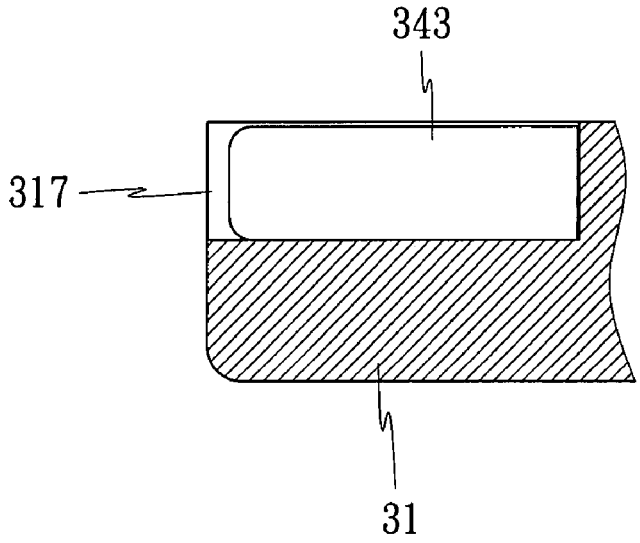
FIG. 5 is a sectional view of a part of the present invention, showing the tailpiece of the hook of FIG. 2 engaged into the supplementary mounting groove of the slide.

As stated above, the hook 34 of the card ejection mechanism 3 is positioned in the main mounting groove 315 of the slide 31, and the metal cover 2 is covered on the electrically insulative housing 1. When installed, the curved tailpiece 343 of the hook 34 is engaged into the supplementary mounting groove 317 at one side of the main mounting groove 315 (see FIG. 5), and the front positioning tip 342 is stopped against the partition block 316 of the slide 3 to hold the hook 34 in place. Therefore, the hook 34 is prohibited from escaping out of the slide 31 during insertion or ejection of the memory card 4.

Figure 4:
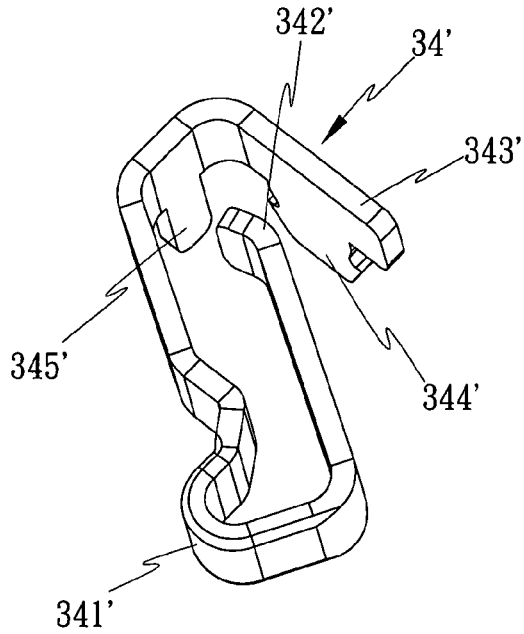
FIG. 4 is an oblique elevation of an alternate form of the hook according to the present invention.
Figure 6:
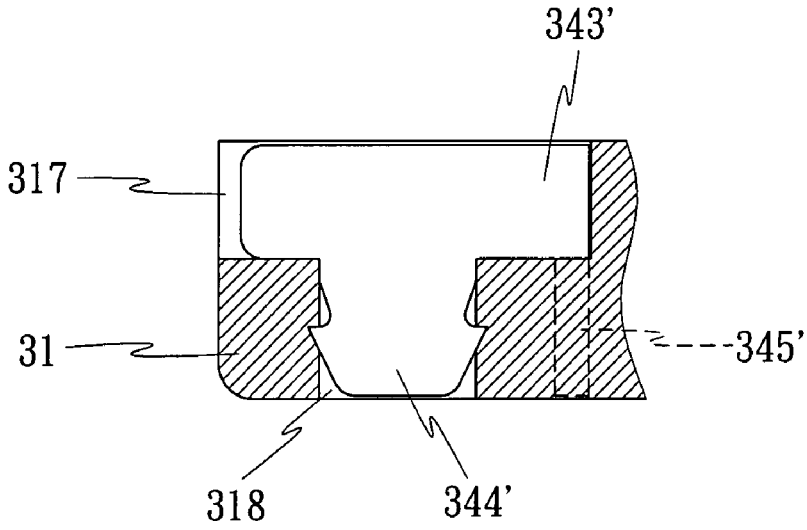
FIG. 6 is a sectional view of a part of the present invention, showing the hook of FIG. 4 mounted in the mounting grooves of the slide.

FIG. 4 shows an alternate form of the hook 34 according to the present invention. According to this embodiment, the hook 34 has a spring arm 341', a front positioning tip 342', and a curved tailpiece 343'. The hook 34 further has a plurality of locating strips 344' and 345' protruded from the curved tailpiece 343' at selected locations for engaging into respective locating holes 318 in the mounting grooves 315 and 317 of the slide 31 (see also FIG. 6), enhancing the positioning of the hook 34 in the slide 31.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A card ejection mechanism mounted in a memory card connector and controllable to eject a memory card that is inserted into said memory card connector, said card ejection mechanism comprising a slide, said slide having a sliding rail and a mounting groove, a spring member connected between said slide and a part inside said memory card connector and adapted to eject the inserted memory card out of said memory card connector, a brake rod hooked between a hook hole in said memory card connector and one end of said sliding rail, and a hook mounted in said mounting groove of said slide for securing the inserted memory card in said memory card connector, wherein said hook has a curved spring arm extending out of said mounting groove of said slide to engage the memory card that is inserted into said memory card connector, and a positioning tip extending from one end of said spring arm and stopped against a wall inside said mounting groove of said slide and adapted to impart a reaction force against impact of the inserted memory card when the inserted memory card is ejected out of said memory card connector by said spring member.

2. The card ejection mechanism as claimed in claim 1, wherein said slide has at least one locating hole in said mounting groove; said hook has at least one locating strip protruded from one side thereof and respectively engaged into a respective locating hole in said slide.

3. The card ejection mechanism as claimed in claim 1, wherein said slide has a partition block disposed in said mounting groove to divide said mounting groove into a main mounting groove and an supplementary mounting groove; said positioning tip of said hook is stopped against said partition block.

4. The card ejection mechanism as claimed in claim 3, wherein said hook has a tailpiece extended from an opposite end of said spring arm and engaged in said supplementary mounting groove.

* * * * *